US012702208B2

(12) United States Patent
Knox

(10) Patent No.: US 12,702,208 B2
(45) Date of Patent: Aug. 11, 2026

(54) FOOTWEAR PROTECTION SYSTEMS AND METHODS FOR USING THE SAME

(71) Applicant: Darryl Knox, Rancho Mission Viejo, CA (US)

(72) Inventor: Darryl Knox, Rancho Mission Viejo, CA (US)

( * ) Notice: Subject to any disclaimer, the term of this patent is extended or adjusted under 35 U.S.C. 154(b) by 0 days.

(21) Appl. No.: 18/786,270

(22) Filed: Jul. 26, 2024

(65) Prior Publication Data

US 2025/0031817 A1 Jan. 30, 2025

Related U.S. Application Data

(60) Provisional application No. 63/516,336, filed on Jul. 28, 2023.

(51) Int. Cl.

| | |
|---|---|
| ***A45C 3/12*** | (2006.01) |
| ***A47L 23/20*** | (2006.01) |
| *A45C 13/10* | (2006.01) |
| *A45C 13/30* | (2006.01) |

(52) U.S. Cl.
CPC ..... *A45C 3/12* (2013.01); *A47L 23/205* (2013.01); *A45C 13/103* (2013.01); *A45C 13/30* (2013.01)

(58) Field of Classification Search
CPC ..... A45C 3/12; A45C 13/103; A45C 13/30; A47L 23/205
See application file for complete search history.

(56) References Cited

U.S. PATENT DOCUMENTS

| | | | | |
|---|---|---|---|---|
| 2,276,765 | A | 3/1942 | Gree | |
| 2,625,752 | A | 1/1953 | Kemp | |
| 2,672,263 | A * | 3/1954 | Alber | A45F 5/00 224/602 |
| 2,813,602 | A | 11/1957 | MacArthur | |
| 3,313,047 | A | 4/1967 | Svien | |
| 3,796,357 | A | 3/1974 | Johnson | |
| D234,326 | S | 2/1975 | Kato | |
| D247,524 | S | 3/1978 | Graham | |
| 4,083,483 | A | 4/1978 | Bayless | |
| 4,126,256 | A | 11/1978 | McGruder | |
| D254,343 | S | 3/1980 | Babcock | |
| 4,258,869 | A | 3/1981 | Hilgendorff | |
| 4,296,499 | A | 10/1981 | Patterson | |
| D272,428 | S | 1/1984 | Kelley | |
| 4,514,915 | A | 5/1985 | Galetta | |
| D292,847 | S | 11/1987 | Barker | |
| 5,129,560 | A | 7/1992 | Herman | |
| D339,680 | S | 9/1993 | Hodges, Jr. | |
| D350,435 | S | 9/1994 | Smith, IV | |
| 5,513,787 | A | 5/1996 | Reed | |
| 5,730,287 | A | 3/1998 | Martin | |
| D408,137 | S | 4/1999 | Leininger | |
| D408,138 | S | 4/1999 | Mracna | |
| 6,010,050 | A | 1/2000 | Tarr | |
| 6,446,849 | B1 | 9/2002 | Schleifer | |

(Continued)

*Primary Examiner* — Shawn M Braden
(74) *Attorney, Agent, or Firm* — Nixon Peabody LLP

(57) ABSTRACT

A system for transporting footwear includes a first sleeve, a second sleeve, and a strap. The strap is removably coupled to the first sleeve and the second sleeve. The first sleeve includes a first pouch configured to be inverted and house therein the first sleeve. The second sleeve includes a second pouch configured to be inverted and house therein the second sleeve.

13 Claims, 13 Drawing Sheets

(56) References Cited

U.S. PATENT DOCUMENTS

| | | | |
|---|---|---|---|
| 6,584,704 | B2 | 7/2003 | March |
| 6,869,219 | B1 | 3/2005 | Sala |
| D578,763 | S | 10/2008 | Walker |
| 7,600,620 | B2 | 10/2009 | Hammond |
| D607,638 | S | 1/2010 | Hensley |
| D641,170 | S | 7/2011 | Thompson |
| D674,189 | S | 1/2013 | Robinson |
| D687,635 | S | 8/2013 | Choi |
| 9,516,935 | B2 | 12/2016 | Rorie |
| 9,635,900 | B1 | 5/2017 | Rolle |
| 9,770,086 | B2 | 9/2017 | Prisco |
| 10,165,841 | B2 | 1/2019 | Dalton |
| D886,450 | S | 6/2020 | Leaks, Jr. |
| 11,089,851 | B2 | 8/2021 | Leaks, Jr. |
| D945,154 | S | 3/2022 | Dini |
| D966,703 | S | 10/2022 | Leaks, Jr. |
| D967,627 | S | 10/2022 | Leaks, Jr. |
| 11,974,656 | B2 | 5/2024 | Mui |
| 2004/0016785 | A1 | 1/2004 | Timmons |
| 2004/0163279 | A1 | 8/2004 | Gadson |
| 2005/0035169 | A1 | 2/2005 | Tabor |
| 2005/0274765 | A1 | 12/2005 | Fischel |
| 2007/0039841 | A1 | 2/2007 | Deloatch-Ratliff |
| 2007/0272570 | A1 | 11/2007 | Brooks |
| 2010/0284631 | A1 | 11/2010 | Lee |
| 2011/0101052 | A1 | 5/2011 | Armstrong |
| 2014/0109437 | A1 | 4/2014 | Burr |
| 2016/0095400 | A1 | 4/2016 | Lawton |
| 2017/0143104 | A1 | 5/2017 | Vera |
| 2017/0150774 | A1 | 6/2017 | Girard |
| 2019/0246774 | A1* | 8/2019 | Becht ..... A45F 3/00 |
| 2019/0254396 | A1* | 8/2019 | Leaks, Jr. ..... A45C 3/12 |
| 2021/0330001 | A1 | 10/2021 | Washington |
| 2023/0014989 | A1 | 1/2023 | Rasmussen |
| 2024/0164473 | A1 | 5/2024 | Putzke |

* cited by examiner

FOOTWEAR PROTECTION SYSTEMS AND METHODS FOR USING THE SAME

CROSS-REFERENCE TO RELATED APPLICATIONS

This application claims the benefit of and priority to U.S. Provisional Application No. 63/516,336, filed Jul. 28, 2023, which is hereby incorporated by reference herein in its entirety.

BACKGROUND

The present disclosure relates generally to footwear protection systems, and, more specifically, to systems that allow users to comfortably and conveniently transport footwear while protecting the footwear from the environment and/or while protecting the environment form the footwear.

Some people require a secondary pair of shoes separate from their everyday pair for jobs, hobbies, competitive sports, etc. For example, athletes require a specialized pair of shoes to compete in their given sport (i.e., basketball players require basketball shoes to play basketball). As another example, outdoor enthusiasts may require hiking boots or waterproof boots. Others may require a second pair of shoes when travelling, whether it be a pair of dress shoes for a wedding, or a pair of sandals for the beach. Often, people pack their secondary pair of shoes in their luggage, throw them in the trunk of their car, or simply carrying them in their hands. However, this is problematic as the secondary pair of shoes, in the case of the traveler, may spread dirt throughout a suitcase, or, in the case of the hand-holder, is awkward to hold and prevents people from holding other items in their hands like smartphones, bags, etc. Another problem with people transporting their shoes in their hands is that the shoes are exposed to the environment. For example, basketball shoes are designed for one specific environment (i.e., the hardwood of a basketball court) and basketball players do not want their shoes to be exposed to rain, snow, or even the concrete of the sidewalk. Consequently, a need exists for systems for securely transporting shoes while protecting shoes from the environment.

SUMMARY

According to some implementations of the present disclosure, a system for use with footwear includes a first sleeve, a second sleeve, and a strap. The first sleeve has a first outer side portion, a first inner side portion, a first heel portion, a first sole portion, a first closure mechanism, a first plurality of attachment members, and a first exterior pocket. The first outer side portion, the first inner side portion, and the first heel portion being coupled together to define a first opening of the first sleeve. Responsive to the first closure mechanism being in an open position, the first outer side portion and the first inner side portion are at least partially disconnected from one another such that the first opening of the first sleeve is in a first configuration to aid the first sleeve in receiving a first of a pair of footwear. Responsive to the first closure mechanism being in a closed position, the first opening of the first sleeve is in a second configuration such that the first sleeve is configured to secure the first of the pair of footwear therein. The first plurality of attachment members is positioned adjacent to the first opening. The first exterior pocket is coupled to an exterior surface of the first heel portion and is configured to be inverted and house therein the first outer side portion, the first inner side portion, the first heel portion, and the first sole portion. The second sleeve has a second outer side portion, a second inner side portion, a second heel portion, a second sole portion, a second closure mechanism, a second plurality of attachment members, and a second exterior pocket. The second outer side portion, the second inner side portion, and the second heel portion being coupled together to define a second opening of the second sleeve. Responsive to the second closure mechanism being in an open position, the second outer side portion and the second inner side portion are at least partially disconnected from one another such that the second opening of the second sleeve in a first configuration to aid the second sleeve in receiving a second of the pair of footwear. Responsive to the second closure mechanism being in a closed position, the second opening of the second sleeve is in a second configuration such that the second sleeve is configured to secure the second of the pair of footwear therein. The second plurality of attachment members is positioned adjacent to the second opening. The second exterior pocket is coupled to an exterior surface of the second heel portion and is configured to be inverted and house therein the second outer side portion, the second inner side portion, the second heel portion, and the second sole portion. The strap is configured to be removably coupled to the first sleeve and the second sleeve, the strap including a pair of coupling mechanisms, each of the pair of coupling mechanisms are configured to couple with one or more of the plurality of attachment members of the first sleeve and one or more of the plurality of attachment members of the second sleeve.

BRIEF DESCRIPTION OF THE SEVERAL VIEWS OF THE DRAWINGS

Disclosed herein are systems pertaining to a bag for transporting footwear, including sleeves corresponding to each footwear and a strap to connect the sleeves that allows for comfortable transportation. This description includes drawings, wherein.

DETAILED DESCRIPTION

People transport shoes for a variety of reasons such as travel, hobbies, competitive sports, etc. Often, people transport shoes by mixing them in with clothes in their luggage, in the trunk of their car, or by holding the shoes in their hands. Typically, this results in people's clothes being dirty or the trunk of their car absorbing the odor that is emitted from the shoes. Further, when people need to transport shoes by holding them, people are unable to do the activities they would prefer to be doing such as browsing the web on their smartphones or holding the hand of a loved one because the shoes consume all their hand space. In the context of competitive sports, athletes typically require more than one pair of shoes. For example, basketball players go to the basketball court wearing their everyday shoes or sandals but require specifically tailored basketball shoes to play basketball. As another example, football players similarly go to the field wearing their everyday shoes or sandals because the traditional football cleats cannot be worn on the pavement, sidewalk, or indoors. Further, athletes' shoes should not be exposed to rain, snow, or even the sidewalk because this causes the shoes to breakdown faster and the athlete does not maximize their use of the shoes. Moreover, athletes' uniforms rarely have pockets, so athletes need a space to store their smartphones, wallets, credit cards, keys, etc. while playing their sport. Athletes currently are forced to store their shoes or cleats in their backpacks, which causes their dirty, odorous shoes to intermingle with their clean clothes, toiletries, and other items. Another problem people face is finding storage spaces within their homes for excess bags or other knickknacks.

Described herein are systems that seek to eliminate these problems by allowing people to transport shoes in a secure manner, without exposure to the environment. Moreover, the systems prevent users from having to mix in their dirty shoes with their clean clothes or clean car. In one implementation of the present disclosure, the systems include a first sleeve, a second sleeve, and a strap. Each sleeve corresponds to a single footwear item, thereby allowing both sleeves to encompass a pair of footwear. Further, a single footwear item is positioned within its corresponding sleeve such that the footwear item is not exposed to the environment, while allowing the inner portions of the footwear item to be ventilated. The strap is removably coupled to each of the first sleeve and the second sleeve. The strap has varying lengths, with allows the users of the systems to position the strap around their neck, shoulder, or in their hand. By doing so, users can transport shoes without using their hands and without needing to mix their dirty shoes in with their clean clothes in a suitcase. The discussion of FIG. 1 provides an overview of an example systems.

Figure 1:
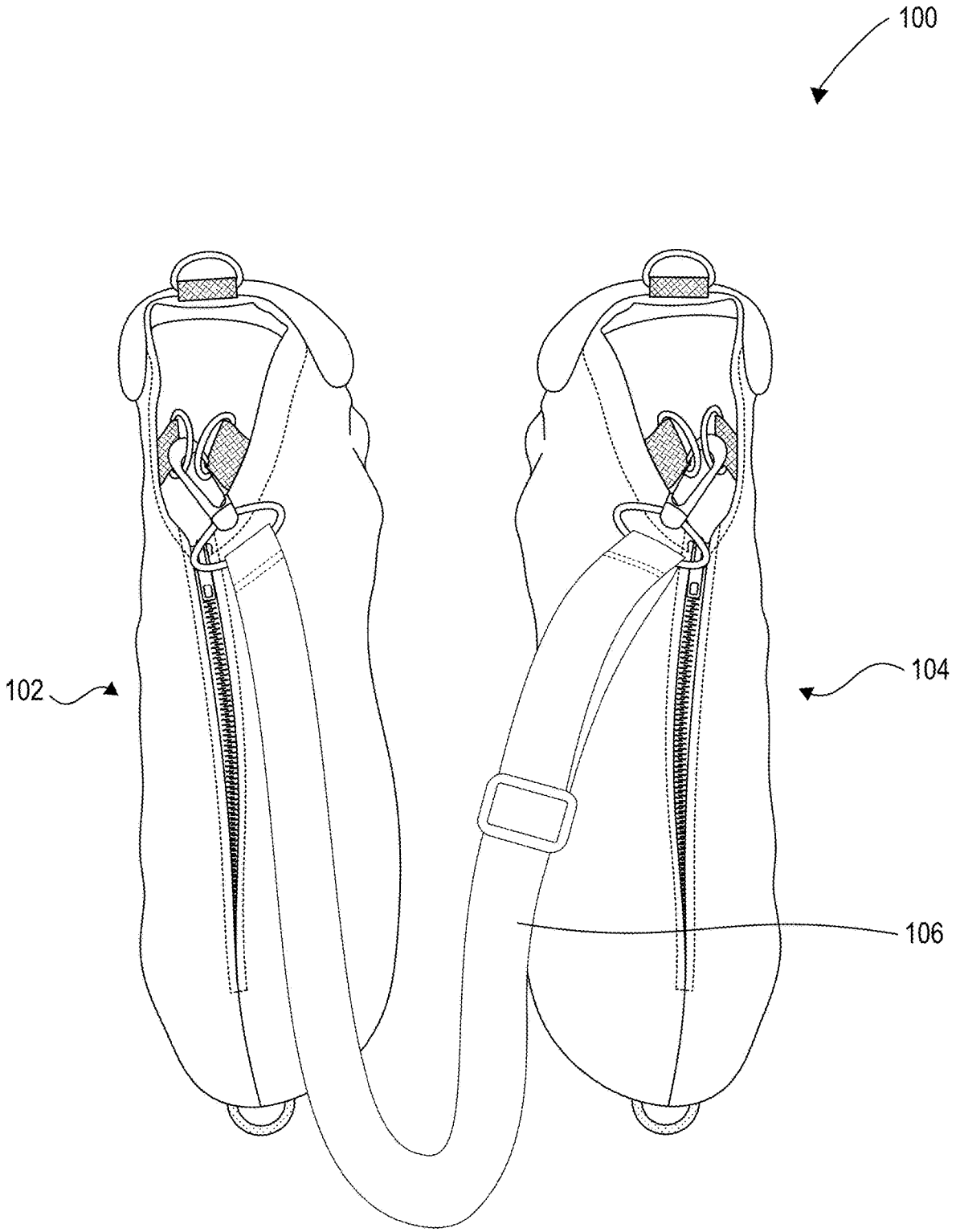
FIG. 1 is a perspective view of a system for transporting footwear, according to some implementations of the present disclosure.

As shown in FIG. 1, the system 100 includes a first sleeve 102, a second sleeve 104, and a strap 106. The first sleeve 102 is configured to receive a first pair of footwear and the second sleeve 104 is configured to receive a second pair of footwear. The strap 106 is removably coupled to both the first sleeve 102 and the second sleeve 104. Once the strap 106 is coupled, the user can hold the strap 106, or position it around their neck, shoulder, etc., to securely transport the footwear without getting the footwear dirty or exposed to the climate.

Figure 2:
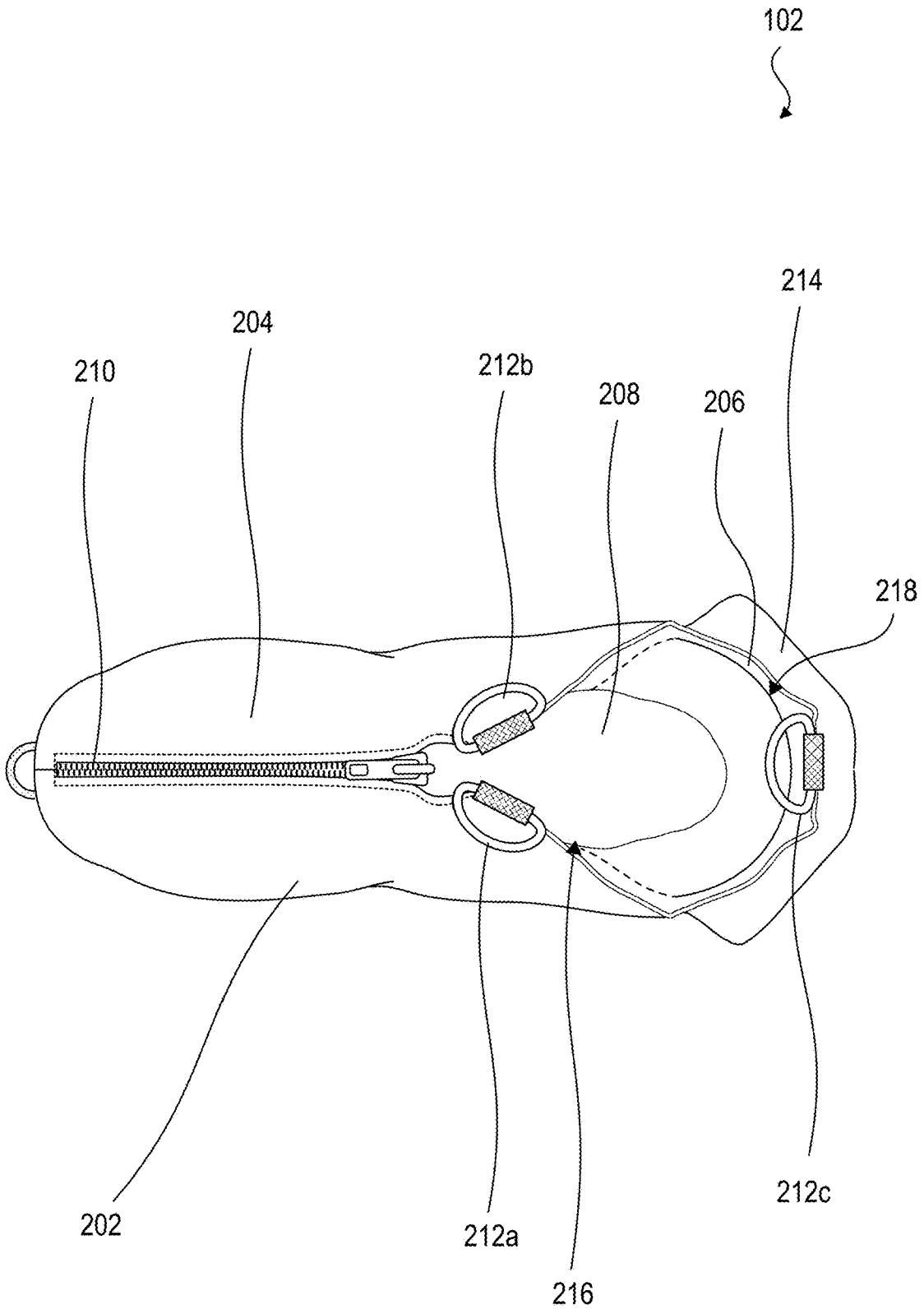
FIG. 2 is a top plan view of a first sleeve of the system of FIG. 1, according to some implementations of the present disclosure.

As shown in FIG. 2, the first sleeve 102 includes an outer side portion 202, an inner side portion 204, a heel portion 206, a sole portion 208, a closure mechanism 210, a first attachment member 212*a*, a second attachment member 212*b*, a third attachment member 212*c*, an exterior pocket 214, and an opening 216. The exterior pocket 214 is coupled to an exterior surface of the heel portion 206. The outer side portion 202, inner side portion 204, heel portion 206, and sole portion 208 are all coupled together to define the opening 216. The outer side portion 202, inner side portion 204, heel portion 206, and sole portion 208 can be made from any suitable material(s). For example, the outer side portion 202, inner side portion 204, heel portion 206, and sole portion 208 can be made from one or a combination of polyester, nylon, cotton, polycotton, etc. The outer side portion 202, inner side portion 204, heel portion 206, and sole portion 208 can each be made from different materials. For example, in one implementation of the present disclosure, the outer side portion 202 can be made from nylon, while the sole portion 208 is made from polyester. In some implementations, the outer side portion 202 and inner side portion 204 are made from one piece of material, while in other implementations, the outer side portion 202 and the inner side portion 204 are made from different pieces of material and are sewn together. Similarly, the exterior pocket 214 can be made from any suitable material(s). For example, the exterior pocket 214 can be made from one or a combination of including nylon, polyester, cotton, polycotton, etc. The closure mechanism 210 is positioned across an outer edge of the outer side portion 202 and an outer edge of the inner side portion 204. As discussed in more detail with respect to FIGS. 3 and 4, the closure mechanism 210 is configured to be in an open position and a closed position. In the FIG. 2 implementation, the closure mechanism 210 is in the closed position. The closure mechanism can come in many forms, for example, the closure mechanism 210 can be a zipper, snap buttons, hook and loop fasteners, etc. Adjacent to the closure mechanism 210, outer side portion 202, and inner side portion 204 is a first attachment member 212*a* and a second attachment member 212*b*. Positioned adjacent to the heel portion 206 is a third attachment member 212*c*. The plurality of attachment member 212*a*, 212*b*, and 212*c* are configured to attach the first sleeve 102 to the strap 106 (not shown). Alternatively, the plurality of attachment members 212*a*, 212*b*, and 212*c* can be positioned anywhere on the first sleeve 102 to allow for the first sleeve 102 to be removably coupled to the strap 106. Any number of attachment members can be used to attach the first sleeve 102 to the strap 106. For example, in some implementations the first attachment member 212*a* and the second attachment member 212*b* attach to the strap 106. In other implementations, only the third attachment member 212*c* attaches to the strap 106. In this implementation, the first sleeve 102 includes three attachment member 212*a*, 212*b*, and 212*c*. However, the disclosure is not so limiting. In some implementations, the first sleeve 102 can include any desired amount of attachment members. For example, in some implementations, the first sleeve 102 can include 1, 2, 4, 6, 10, etc. attachment members.

The manner in which the user attaches the strap 106 to one or a combination of the three attachment members 212*a*, 212*b*, 212*c* achieves varying goals. For example, if the goal of the user is to air out their shoe as much as possible while still transporting the shoe within the first sleeve 102, the user may attach the strap 106 to the first attachment member 212*a* and the second attachment member 212*b*. By attaching the strap 106 to the first attachment 212*a* and the second attachment member 212*b*, user can configure the closure mechanism 210 to be in the open position while transporting their shoe. This allows for the shoe to receive more air during transportation, thus, diminishing the effects of shoe odor and limiting the amount of additional odor buildup within the shoe. Conversely, if the user seeks maximum protection from the environment, thus, preventing any precipitation or dust from accumulating on or within the shoe, the user may attach the strap 106 to all three attachment members 212*a*, 212*b*, 212*c*. In yet another way of attaching the strap 106, if the user desires to have easy access to their shoe (e.g., the user is at a shoe convention and wants to show the shoe around), the user can attach the strap 106 to the third attachment member 212*c*. When the strap 106 is attached in this way, the user can configure the closure mechanism 210 to be in the closed position during transportation, and if the user wants to remove the shoe from the first sleeve 102, the user can configure the closure mechanism 210 to be in the open position thereby allowing easy access to the shoe while ensuring the first sleeve 102 stays coupled to the strap 106.

Figure 3:
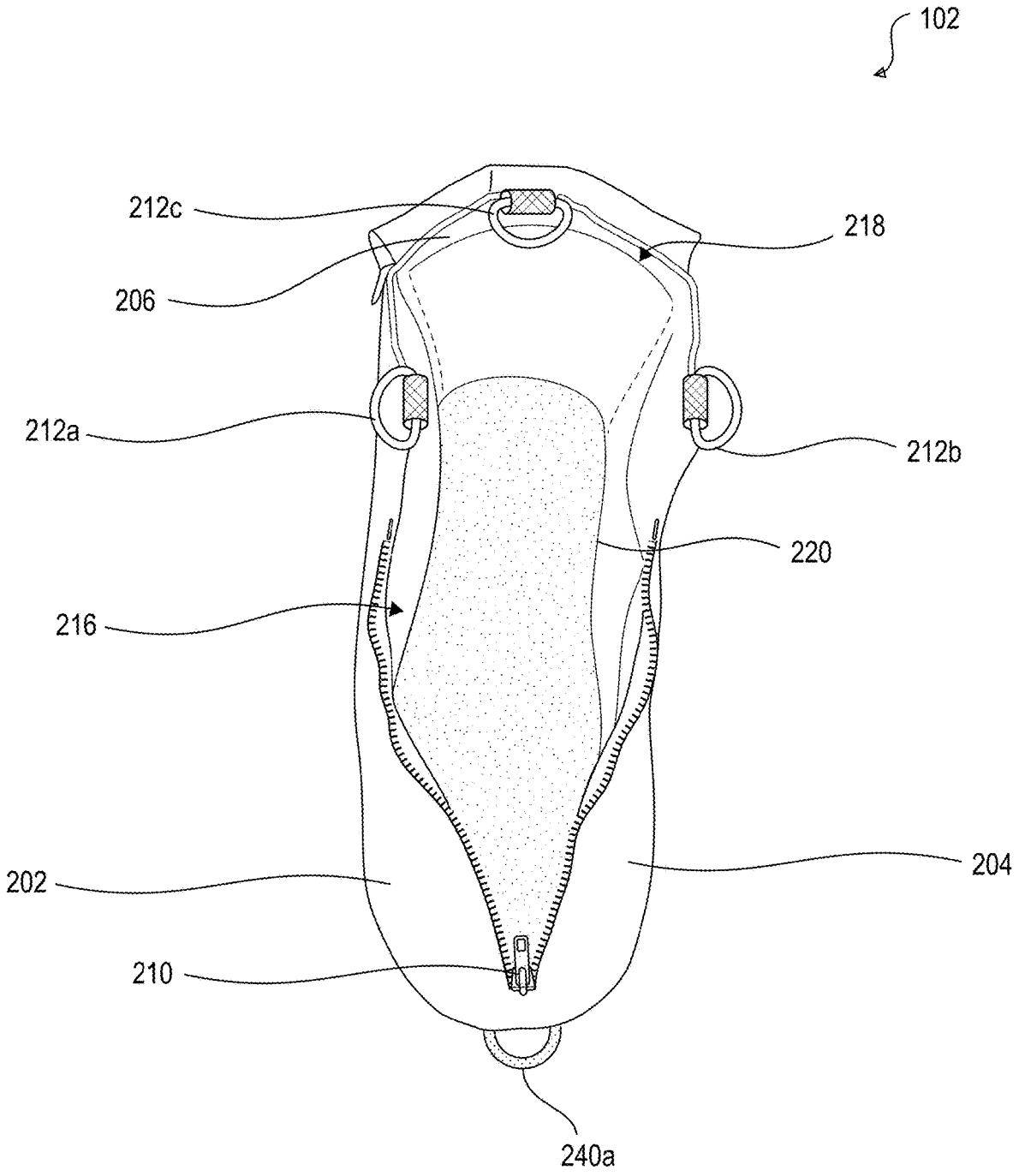
FIG. 3 is a front perspective view of the first sleeve of FIG. 2 in an open position, according to some implementations of the present disclosure.

Referring to FIG. 3, the sleeve 102 of the system 100 is shown with an optional sole insert 220 that is configured to be positioned directly on the sole portion 208 (shown in FIG. 2). The sole insert 220 is made of composite material which provides stability to the first sleeve. For example, if the outer side portion 202, the inner side portion 204, the heel portion 206, and the sole portion 208 are made from polyester, the first sleeve 102 may lack sufficient stability for the user to properly position a shoe within the first sleeve 102. Thus, by positioning the sole insert 220, which maintains its structure relative to the outer side portion 202, the inner side portion 204, the heel portion 206, and the sole portion 208, directly onto the sole portion 208 within the first sleeve 102, the first sleeve 102 will better maintain its structure. This allows the user to easily place their shoe within the first sleeve 102. Further, it is contemplated that athletes who are required to wear cleats or spikes for their given sport (e.g., softball players) will use the first sleeve 102 to store and/or transport a first one of a pair of cleats or spikes. The sole insert 220 prevents the first one of the pair of cleats or spikes from piercing through the first sleeve 102. The sole insert 220 also prevents the sole portion 208 from being dangerously sharp when the first one of the pair of cleats or spikes is positioned with the first sleeve 102 (i.e., it could prevent injuries from the user swinging the first sleeve 102 and making contact with another user directly against the sole portion 208).

In some implementation, the first sleeve 102 may optionally include a hidden pocket 218 that is configured to be positioned along the inner surface of the heel portion 206. The hidden pocket 218 can be made from one or a combination of polyester, nylon, cotton, polycotton, etc. The hidden pocket 218 allows the user to store various belongings, such as keys, cell phones, wallets, credit cards, watches, etc. Such a feature is especially useful for athletes or user's whose pants, shorts, and/or other clothes do not have pockets.

It should be noted that, as discussed with respect to FIG. 1, the system 100 includes a first sleeve 102 and a second sleeve 104. In some implementations, the first sleeve 102 is identical to the second sleeve 104. In other implementations, the first sleeve 102 is the inverse of the second sleeve 104 to accompany the differences between a first of a pair of footwear (i.e., the right shoe) and a second of a pair of footwear (i.e., the left shoe). Throughout the description of the various implementations, the sleeves are described as if the second sleeve 104 is identical to the first sleeve 102.

As shown in FIG. 3, the closure mechanism 210 is in the open position. When the closure mechanism 210 is in the open position, the outer side portion 202 and the inner side portion 204 are partially disconnected, thereby enlarging the opening 216, so as to allow for the first sleeve 102 to receive a first of a pair of footwear. While the opening 216 is enlarged, the first of the pair of footwear is positioned to fit within the first sleeve 102, such that the sole of the footwear is positioned directly adjacent to the sole portion 208 of the first sleeve 102. Further, the heel of the first of the pair of footwear is positioned directly adjacent to the heel portion 206. Generally, the first sleeve 102 is dimensioned according to the size of the first of the pair of footwear. For example, if the first of the pair of footwear is 12 inches long, the first sleeve 102 has a length of at least 12 inches. Similarly, if the first of the pair of footwear is 4 inches wide, the first sleeve 102 has a width of at least 4 inches. Moreover, if the first of the pair of footwear has a height of 6 inches, the first sleeve 102 has a height of at least 6 inches. In sum, the first sleeve 102 is dimensioned to allow the first sleeve 102 to fully surround and encase the first of the pair of footwear.

Figure 4:
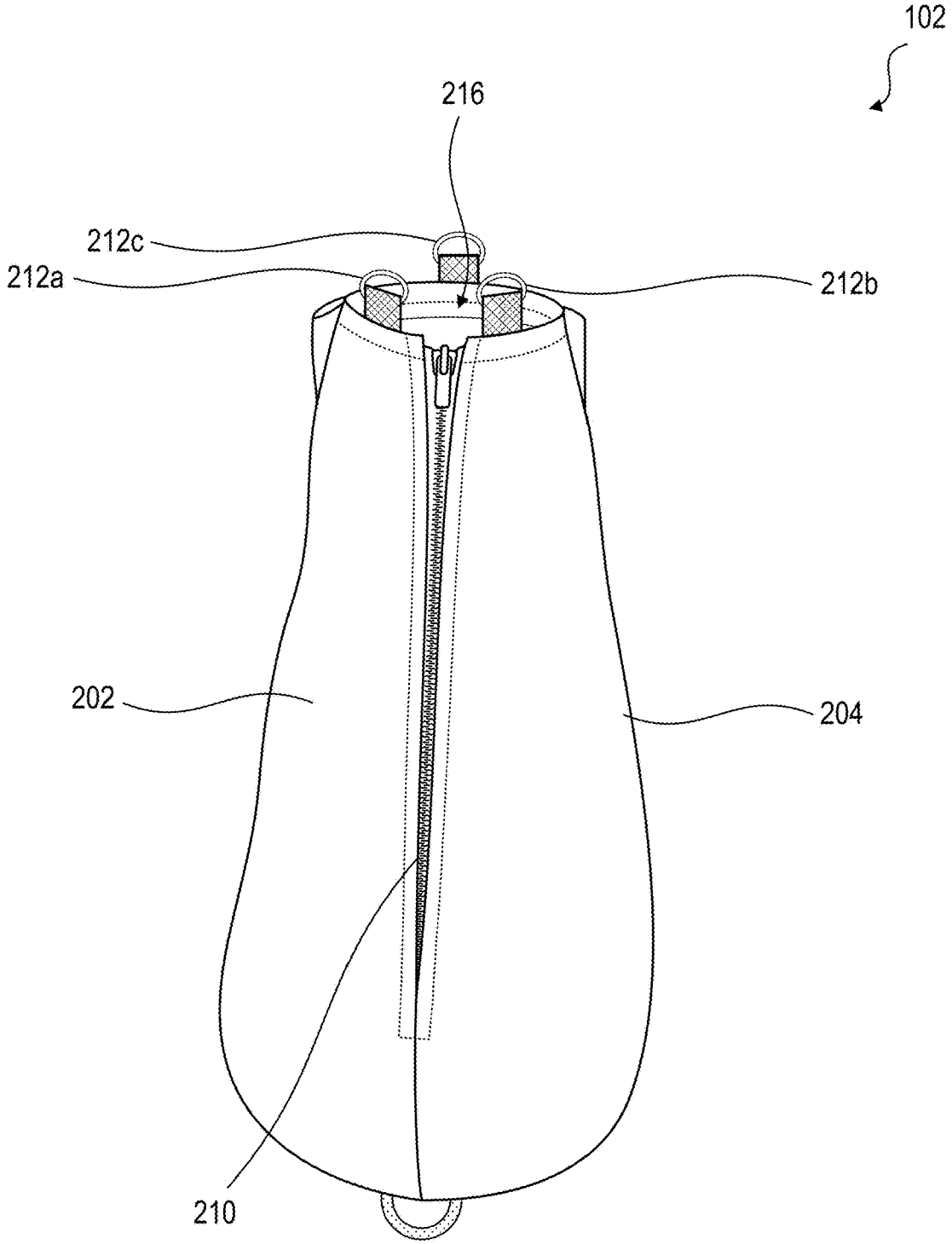
FIG. 4 is a front perspective view of the sleeve of FIG. 2 in a closed position, according to some implementations of the present disclosure.

As shown in FIG. 4, the closure mechanism 210 of the first sleeve 102 is in the closed position. When the closure mechanism 210 is in the closed position, the outer edge of the inner side portion 204 is directly adjacent to the outer edge of the outer side portion 202, thereby decreasing the size of the opening 216 and allowing the first of the pair of footwear to be secured within the first sleeve 102. As discussed with respect to FIG. 3, the first sleeve 102 can fully surround and encase the first of the pair of footwear. By closing the closure mechanism 210, the first of the pair of footwear is securely retained with the first sleeve 102, such that the only part of the first of the pair of footwear that is exposed to the environment is the portion in which a user would insert their foot which corresponds to the opening 216 of the first sleeve 102. This allows for the inner lining of the first of the pair of footwear to breathe, thereby preventing moisture or bacteria from being trapped within the first sleeve 102 while the first sleeve 102 retains the first of the pair of footwear.

Figure 5:
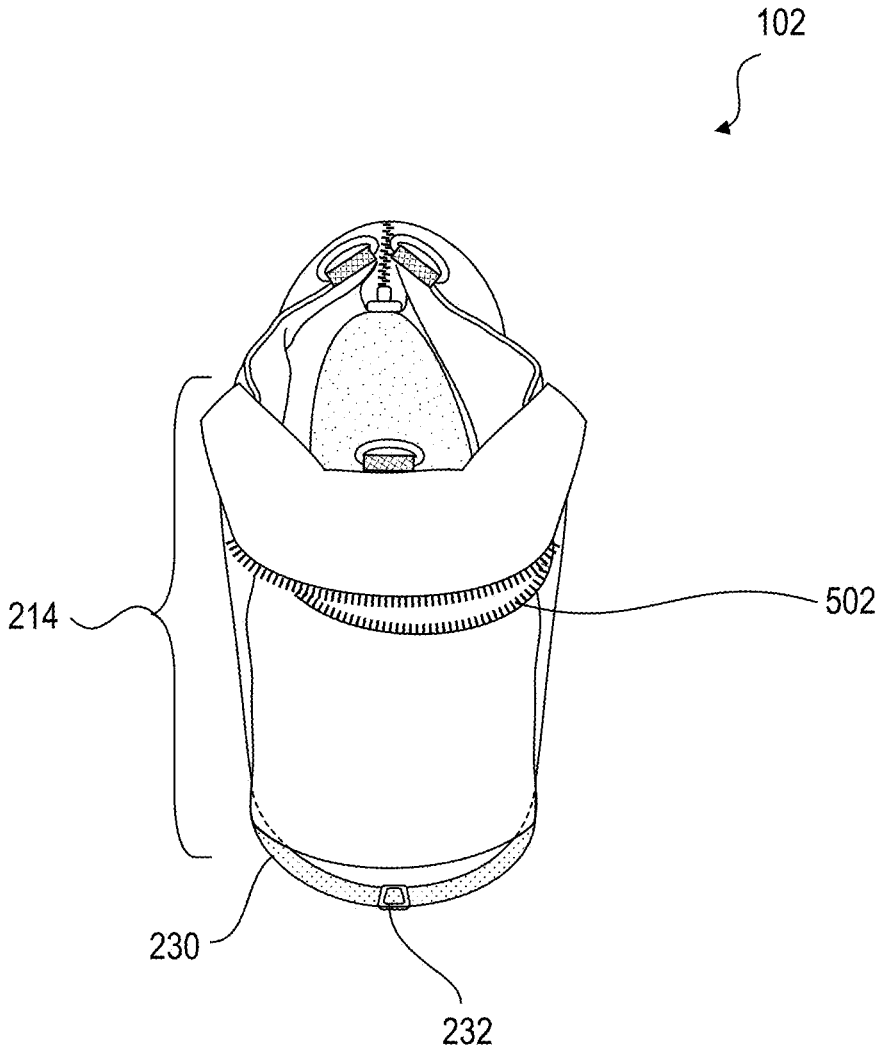
FIG. 5 is a rear perspective view of the sleeve of FIG. 2, according to some implementations of the present disclosure.

As shown in FIG. 5, the first sleeve 102 includes an exterior pocket 214. The exterior pocket 214 is coupled to an exterior surface of the heel portion. The exterior pocket 214 includes a closure mechanism of the exterior pocket 502. The closure mechanism of the exterior pocket 502 allows the user to store various belongings, such as keys, cell phones, wallets, credit cards, watches, etc. Such a feature is especially useful for athletes or user's whose pants, shorts, and/or other clothes do not have pockets. For example, if a user were to wear the system 100 as disclosed with respect to FIG. 1, the user could securely transport their belongings without needing to carry said belongings in their hands. In some implementations, the closure mechanism 502 is positioned on the outer surface of the exterior pocket 214. However, the disclosure is not so limiting. In some implementations, the exterior pocket 214 also functions to secure the entirety of a first sleeve 102, a second sleeve 104, or a combination of the first sleeve 102 and the second sleeve 104, as discussed in more detail with respect to FIGS. 8A and 8B.

According to some implementations, the first sleeve 102 includes a loop 230 that is configured to be positioned on the outer surface of the sole portion 208. The loop 230 is configured to allow, for example, baseball and/or softball athletes to couple the first sleeve 102 onto their baseball and/or softball bat. The loop 230 includes a slide adjuster 232 that allows the loop 230 to become bigger (to fit the loop 230 around the circumference of the baseball and/or softball bat) or smaller (to tighten the loop 230 around the circumference of the baseball and/or softball bat, thus coupling the loop 230 to the baseball and/or softball bat). The loop 230 can be made of any durable material such as one or a combination of polyester, nylon, cotton, polycotton, etc. When the user couples the first sleeve 102 to the baseball and/or softball bat via the loop 230, the user can carry and transport their baseball and/or softball cleats and spikes (or their everyday shoes) hands-free.

Figure 6:
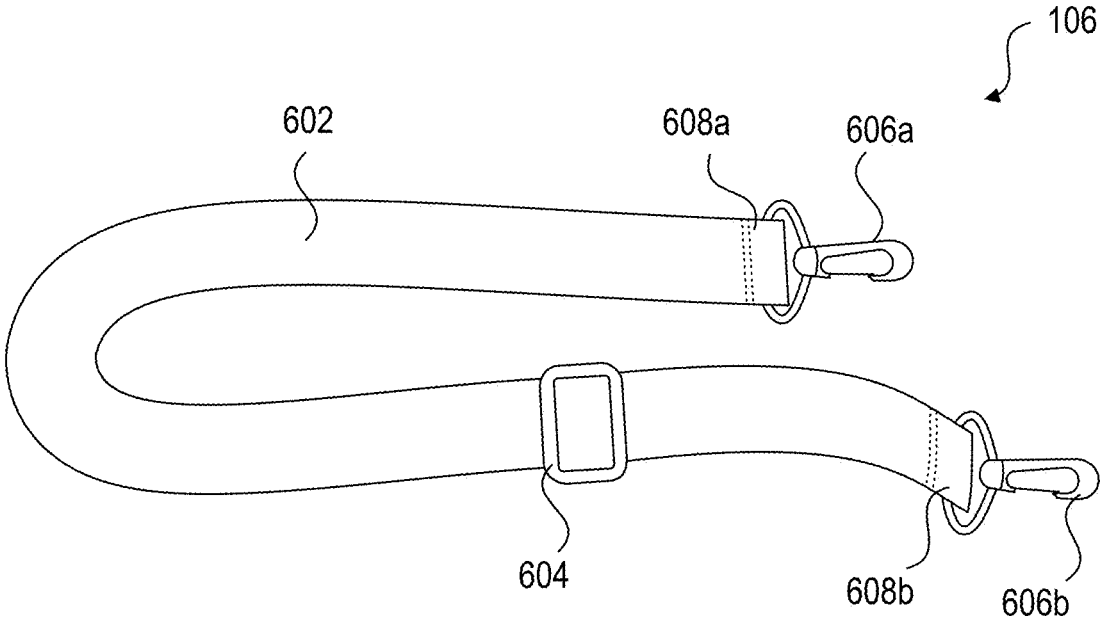
FIG. 6 is a perspective view of a strap of the system of FIG. 1, according to some implementations of the present disclosure.

As shown in FIG. 6, the strap 106 includes a connector 602, an adjusting mechanism 604, a plurality of attachment mechanisms 606*a*, 606*b*, and a plurality of attachment retainers 608*a*, 608*b*. The connector 602 functions to connect the first attachment retainer 608*a* to the second attachment retainer 608*b*. The connector 602 can be various lengths, depending on the needs of the user. The length is adjusted by the slide adjuster 604. For example, if the user is tall (e.g., 6'6"), the connector 602 would need to be longer compared to if the user were short (e.g., 5'3"). Moreover, if the user is female, the connector 602 may also need to be longer such that the sleeves, once removably attached to the strap 106, do not interfere with the female's chest. The first attachment retainer 608*a* and second attachment retainer 608*b* function to secure the first attachment mechanism 606*aa* and second attachment mechanism 606*b*, respectively. The first attachment mechanism 606*a* and second attachment mechanism 606*b* function to removable attach the strap 106 to the first sleeve 102 and the second sleeve 104, respectively.

Figure 7:
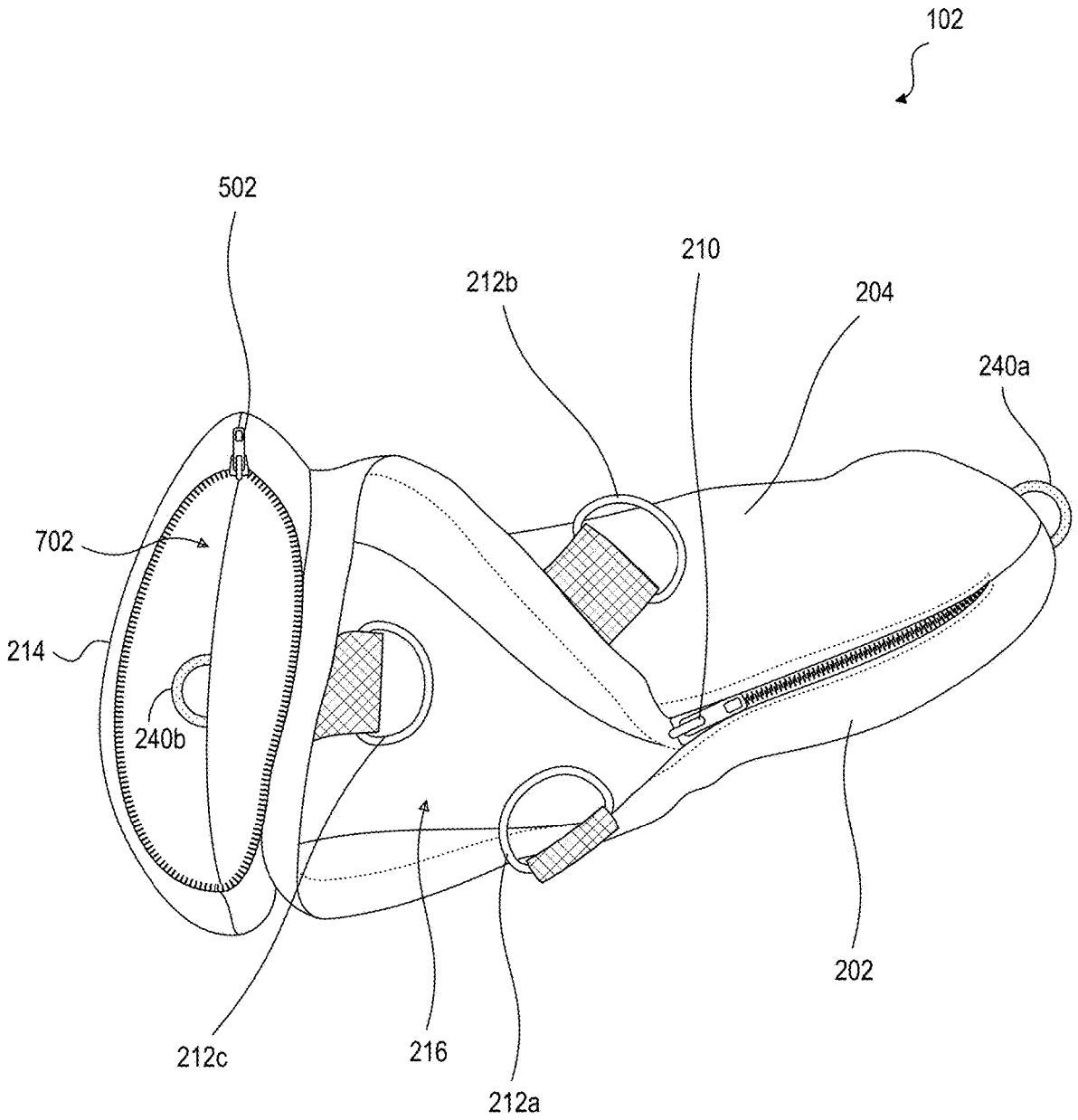
FIG. 7 is a perspective view of the sleeve of FIG. 2 with a storage pocket open and ready to convert the sleeve into a stored position, according to some implementations of the present disclosure.

As shown in FIG. 7, the first sleeve 102 includes the inner side portion 204, the outer side portion 202, the closure mechanism 210, the plurality of attachment members 212*a*, 212*b*, and 212*c*, the opening 216, and the exterior pocket 214. The exterior pocket 214 includes the closure mechanism of the exterior pocket 214. When the closure mechanism of the exterior pocket 502 is open, a pocket opening 702 forms. Conversely, when the closure mechanism of the exterior pocket 502 is closed, the pocket opening 702 is not present. In this implementation, the closure mechanism of the exterior pocket 502 is positioned on the top surface of the exterior pocket 214. The closure mechanism of the exterior pocket 502 allows the user to store various belongings, such as keys, cell phones, wallets, credit cards, watches, etc.

Figure 8A:
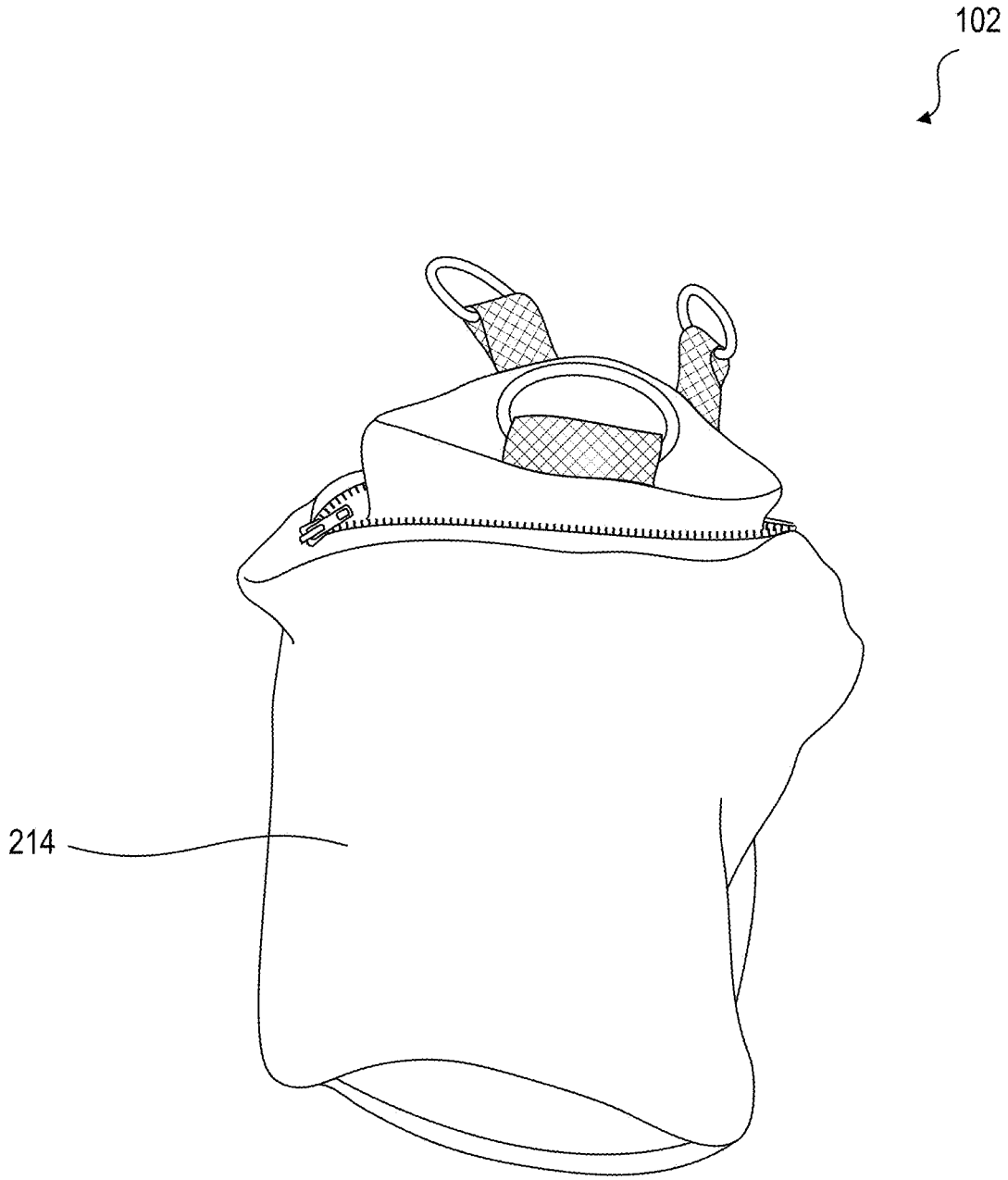
FIG. 8A is a perspective view of the sleeve of FIG. 7 partially positioned within the open pocket to convert the sleeve into the stored position, according to some implementations of the present disclosure.

As shown in FIG. 8A, the first sleeve 102 is bunched together and pushed into the exterior pocket 214 of the first sleeve 102. In some implementations, the exterior pocket 214 is folded inside-out such that exterior surface of the exterior pocket 214 as shown in FIG. 5 becomes the interior surface. In other words, with respect to FIG. 9A, the exterior pocket 214 is folded inside-out such that the exterior surface was at one point the interior surface. To fold the sleeve inside-out, the user must first open the closure mechanism 502 of the exterior pocket 214 such that a pocket opening 702 is formed as shown with respect to FIG. 7. The user then configures the elements of the first sleeve 102 to be put through the pocket opening 702, such that the bottom of exterior pocket 214 and the remaining first sleeve 102 elements come through the pocket opening 702. Once all of the elements of the first sleeve 102 have been put through the pocket opening 702, the first sleeve 102 has been successfully folded inside-out (i.e., positioned in the stored configuration).

In this implementation of the present disclosure, the first sleeve 102 has been folded inside-out and the elements of the first sleeve 102 are secured within the exterior pocket 214. In other implementations, exterior pocket 214 is configured to hold the elements of the first sleeve 102, the second sleeve 104, and the strap 106. In other words, with respect to FIG. 1, the system 100 including the first sleeve 102, the second sleeve 104, and the strap 106 can be configured to fit within the exterior pocket 214 of the first sleeve 102.

Figure 8B:
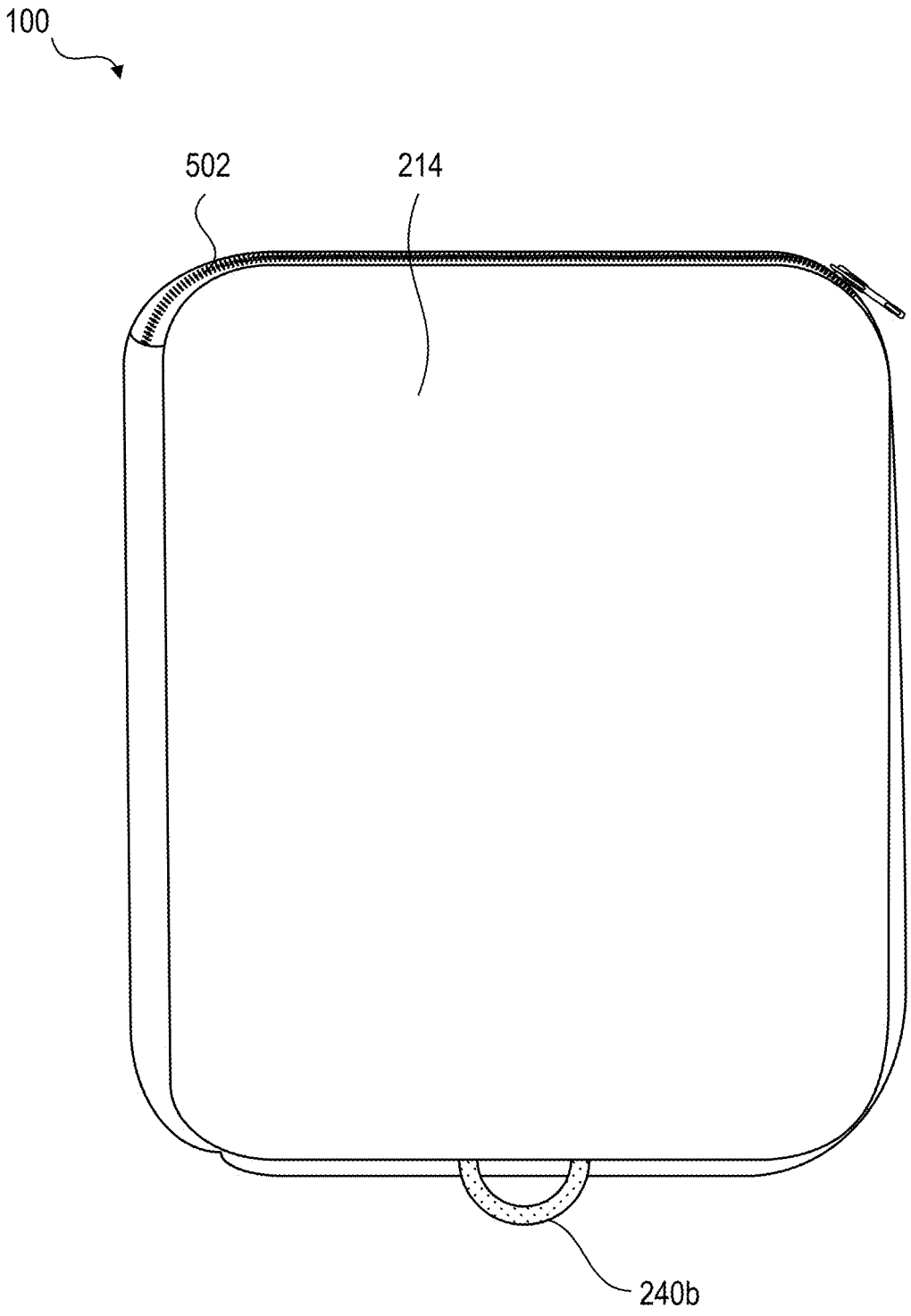
FIG. 8B is a perspective view of the sleeve of FIG. 7 fully positioned within the open pocket and in the stored position, according to some implementations of the present disclosure.

As shown in FIG. 8B, the system 100 has been folded down such that it is retained within the exterior pocket 214. In this implementation, the first sleeve 102, second sleeve 104, and strap 106 are all stored within the exterior pocket 214. The closure mechanism 210 of the exterior pocket 502 of the exterior pocket 214 is closed, such that the first sleeve 102 is inverted and the second sleeve 104 and the strap 106 are secured within the exterior pocket 214 of the first sleeve 102. In this stored configuration, the system 100 has a limited surface area and takes up less space, such that the system 100 can easily be placed in a storage area without taking up a lot of storage space.

Figure 8C:
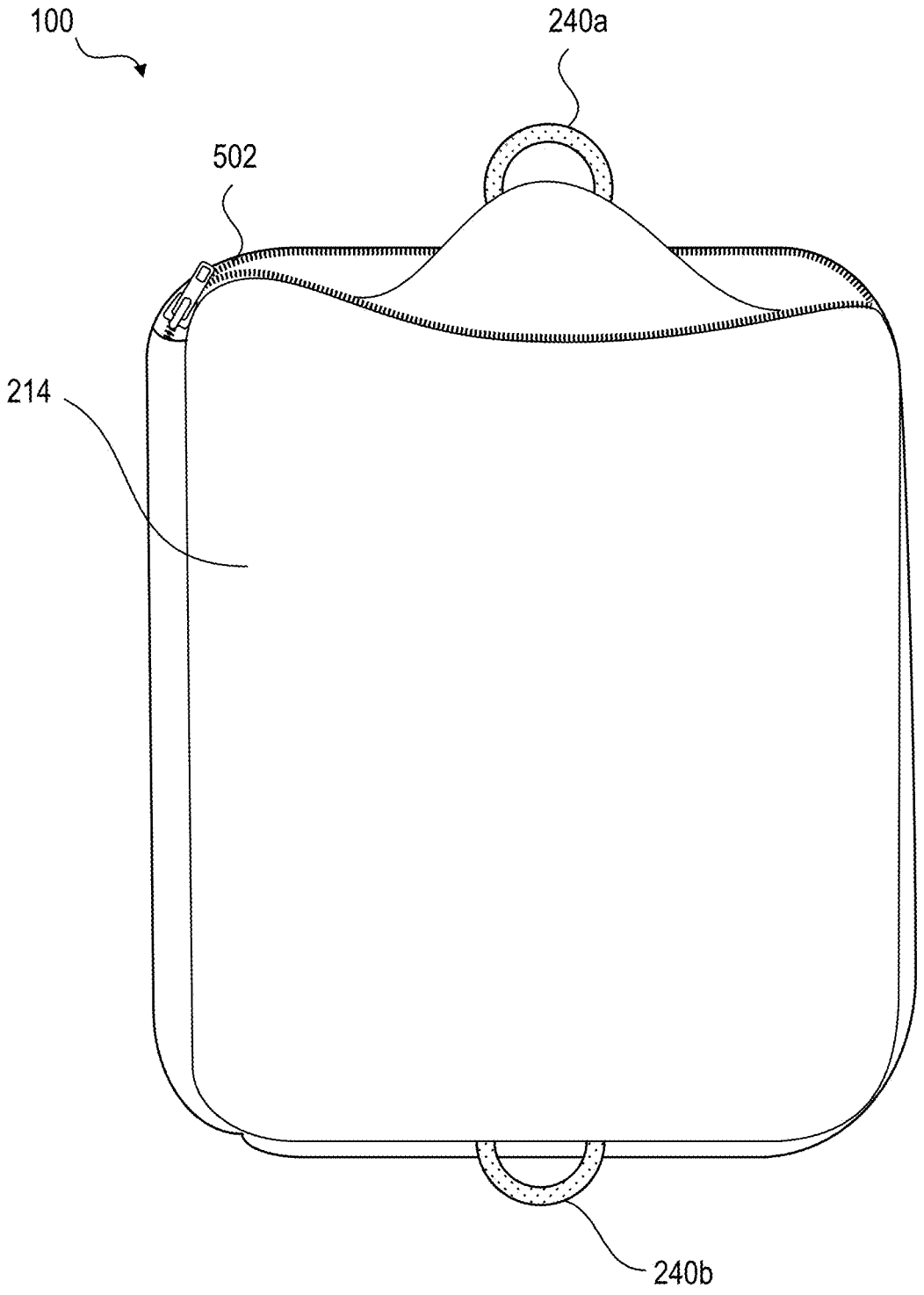
FIG. 8C is a perspective view of the sleeve of FIG. 7 with a portion protruding from the opened pocket to convert the sleeve back from the stored position to the use position, according to some implementations of the present disclosure.

In some implementations, the first sleeve 102 includes a pair of bootstraps 240*a*, 240*b* to aid in removing the second sleeve 104 and the strap 106 from the exterior pocket 214 of the first sleeve 102 and reverse the first sleeve 102. As shown in FIG. 7, the first of the pair of bootstraps 240*a* is coupled to the distal tip of the first sleeve 102 and the second of the pair of bootstraps 240*b* is positioned within the exterior pocket 214. As best shown in FIG. 8C, the pair of bootstraps 240*a*, 240*b* allow the user to readily unfold the folded down system 100 by pulling the first of the pair of bootstraps 240*a* in a first direction and pulling the second of the pair of bootstraps 240*b* in a second direction, the first direction being opposite the second direction. By doing so, first sleeve 102 will transition from its stored configuration to its use configuration and during that transition, the second sleeve 104 and the strap 106 will be removed from within the exterior pocket 214 of the first sleeve 102. In some implementations, the first sleeve 102 includes the pair of bootstraps 240*a*, 240*b* while the second sleeve 104 does not include the pair of bootstraps 240*a*, 240*b*. In other configurations, both the first sleeve 102 and the second sleeve 104 include a pair of bootstraps 240*a*, 240*b*.

Figure 9A:
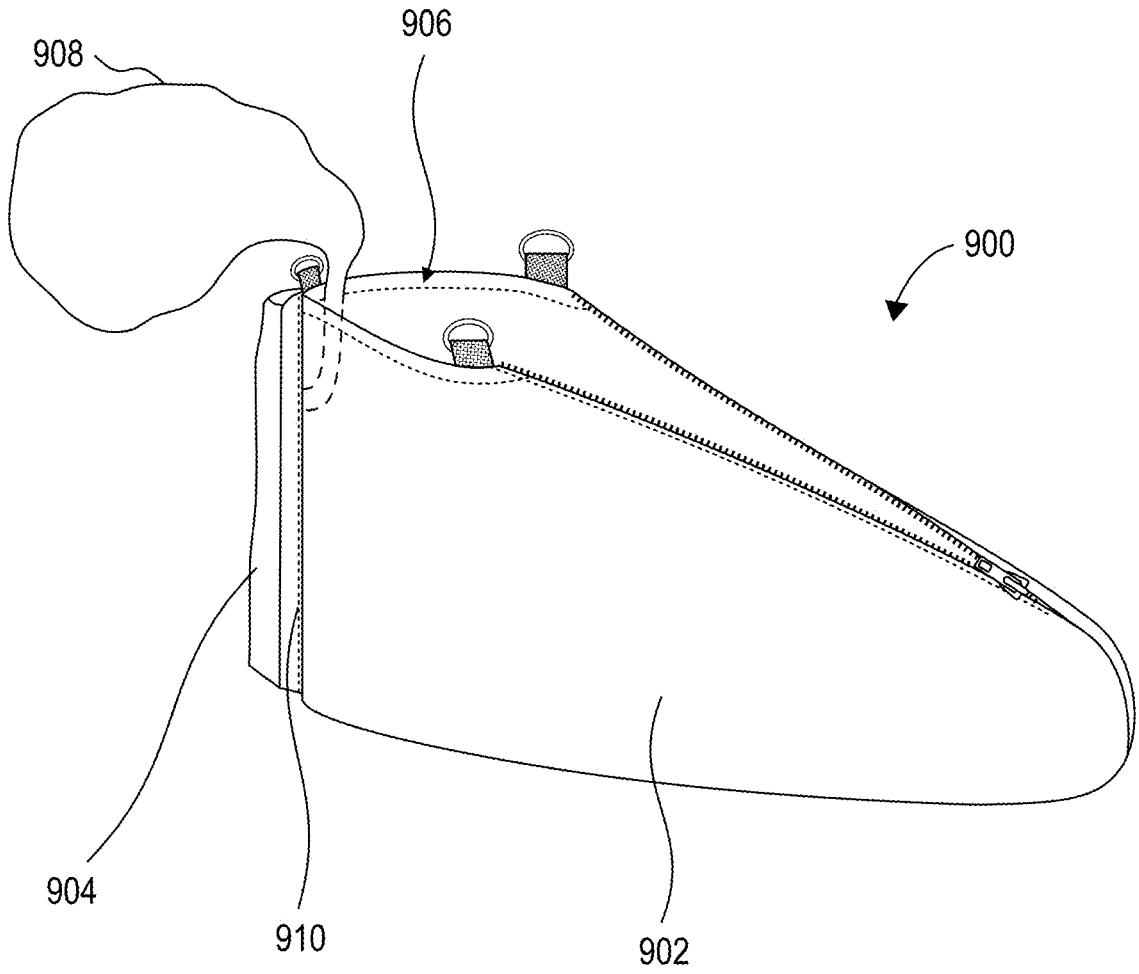
FIG. 9A is a side perspective view of a sleeve with a deodorizing element in a first position such that the sleeve is ready to receive a shoe therein, according to some implementations of the present disclosure.

As shown in FIG. 9A, an alternative sleeve 900 is shown for use in a system similar to or the same as the system 100. The sleeve 900 includes an outer side portion 902, a heel portion 910, an interior pouch 908, and an opening 906. The interior pouch 908 is coupled to an interior surface of the heel portion 910. The interior pouch 908 may be positioned in a first position such that a portion of the interior pouch 908 is adjacent to the exterior surface of the heel portion 910. The user can store various items within the interior pouch 908. For example, the user can position a deodorizer material, a battery powered fan, a battery powered heating element, and/or antimicrobial material in the interior pouch 908. Alternatively, the user may store various belongings, such as keys, cell phones, wallets, credit cards, watches, etc. in the interior pouch 908.

Figure 9B:
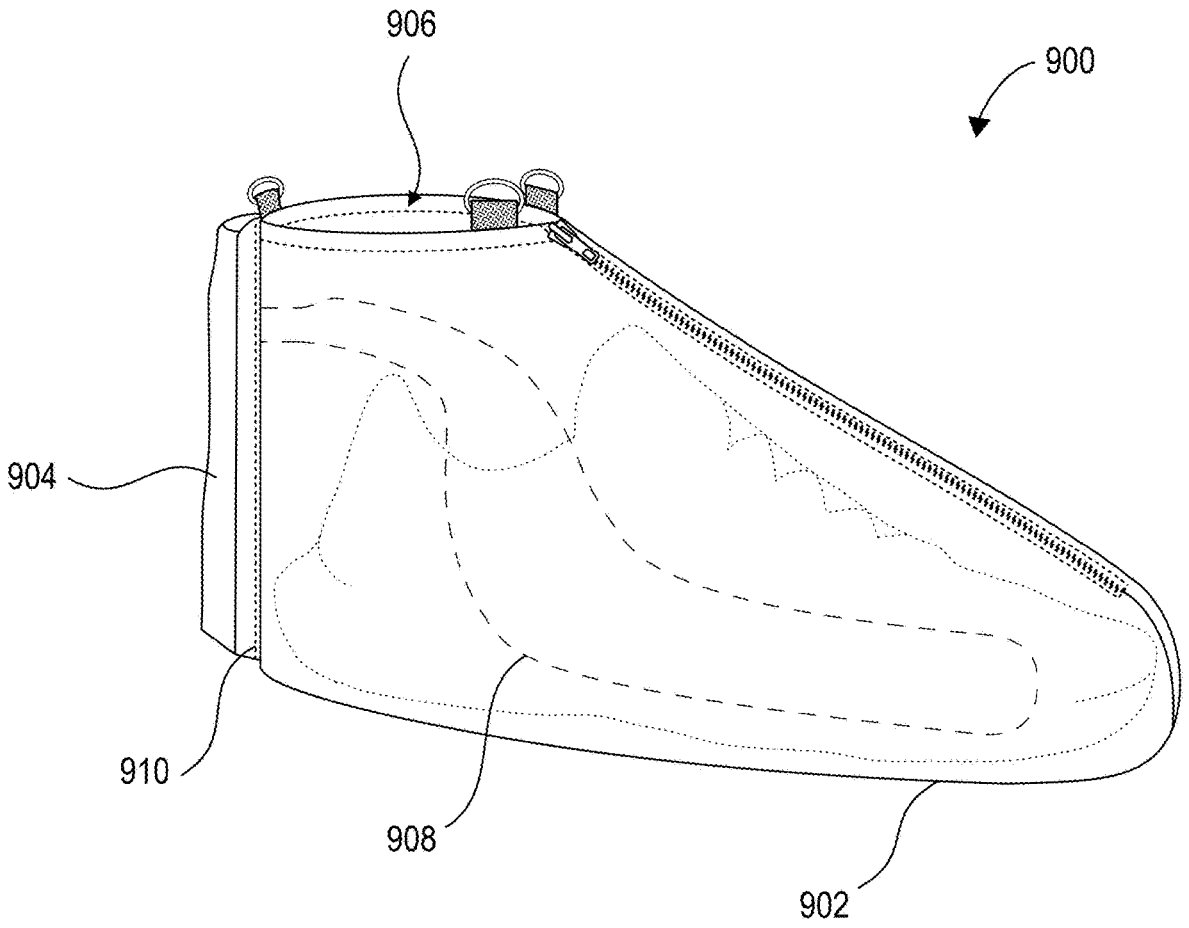
FIG. 9B is a perspective view of the sleeve of FIG. 9A with a shoe therein and the deodorizing element in a second position such that the deodorizing element is positioned at least partially within the shoe, according to some implementations of the present disclosure.

As shown in FIG. 9B, the interior pouch 908 of the alternative sleeve 900 is in a second position such that the interior pouch 908 is within the sleeve 900 and adjacent to an interior surface of the heel portion 910 and the interior surface of the outer side portion 902. When the first of the pair of footwear is secured within the sleeve 900, the interior pouch 908 may be positioned within the first of the pair of footwear. In some implementations, the interior pouch 908 has an extended generally tubular shape. In some implementations, the interior pouch 908 has a length that is about 50% of the sleeve 900. For example, if the sleeve 900 has a length of 12 inches, the interior pouch 908 has a length of 6 inches. However, the disclosure is not so limiting. The interior pouch 908 can have a length that is about 25%, 40%, 75%, 110%, etc. of the length of the sleeve 900. When the length of the interior pouch 908 is greater than the length of the sleeve 900, the interior pouch 908 will curve within the sleeve 900 such that the interior pouch 908 remains enclosed within the sleeve 900. This allows for the interior pouch 908 to be in contact with a larger surface area of the sole portion (not shown) of the sleeve 900. This is beneficial if the user inserts a deodorizer material, a battery powered fan, or a batter powered heating element into the interior pouch 908 because the deodorizer material, fan, or heating element will have a larger surface area within with to deodorizer, vent, or heat, respectively.

Figure 10:
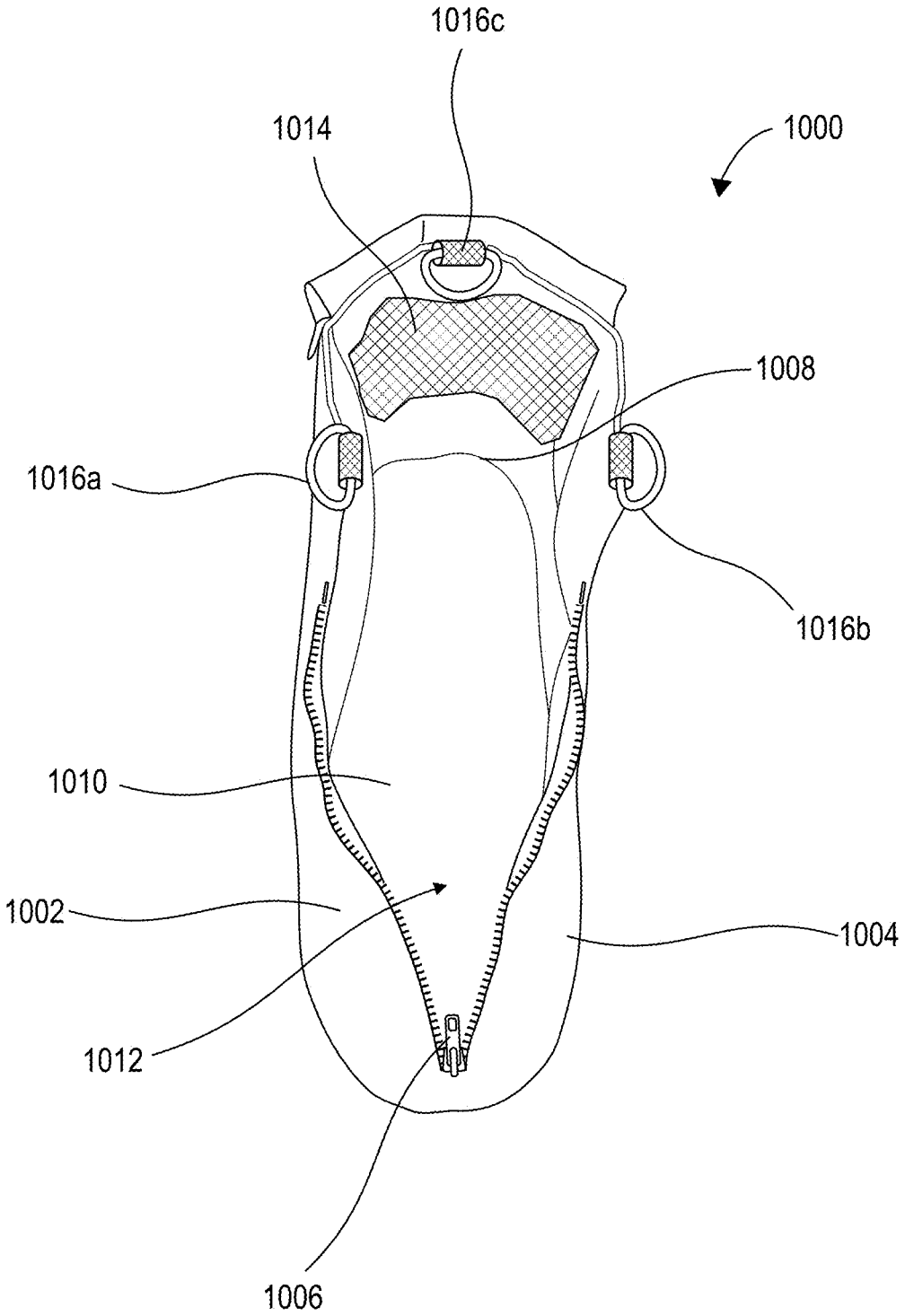
FIG. 10 is a perspective view of a sleeve with a fixed interior pocket, according to some implementations of the present disclosure.

As shown in FIG. 10, an alternative sleeve 1000 is shown for use in a system similar to or the same as the system 100. The sleeve 1000 includes an outer side portion 1002, an inner side portion 1004, a closure mechanism 1006, a heel portion 1008, a sole portion 1010, an opening 1012, an interior pocket 1014, and a plurality of attachment members 1016*a*, 1016*b*, and 1016*c*. The interior pocket 1014 is fixed to the interior surface of the heel portion 1008. Because the interior pocket 1014 is fixed to the heel portion 1008, the user can discretely store their belongings within the interior pocket 1014. For example, the user may store various belongings, such as keys, cell phones, wallets, credit cards, watches, etc. in the interior pocket 1014. Alternatively, the user can position a deodorizer material, a battery powered fan, a battery powered heating element, and/or antimicrobial material in the interior pocket 1014.

Those skilled in the art will recognize that a wide variety of other modifications, alterations, and combinations can also be made with respect to the above-described implementations without departing from the scope of the disclosure, and that such modifications, alterations, and combinations are to be viewed within the ambit of the inventive concept.

What is claimed is:

1. A system for use with footwear comprising:

a first sleeve having a first outer side portion, a first inner side portion, a first heel portion, a first sole portion, a first closure mechanism, a first plurality of attachment members, and a first exterior pocket, the first outer side portion, the first inner side portion, and the first heel portion being coupled together to define a first opening of the first sleeve, responsive to the first closure mechanism being in an open position, the first outer side portion and the first inner side portion are at least partially disconnected from one another such that the first opening of the first sleeve is in a first configuration to aid the first sleeve in receiving a first of a pair of footwear therein, responsive to the first closure mechanism being in a closed position, the first opening of the first sleeve is in a second configuration such that the first sleeve is configured to secure the first of the pair of footwear therein, the first plurality of attachment members being positioned adjacent to the first opening, the first exterior pocket being coupled to an exterior surface of the first heel portion and being configured to be inverted and house therein the first outer side portion, the first inner side portion, the first heel portion, and the first sole portion;

a second sleeve having a second outer side portion, a second inner side portion, a second heel portion, a second sole portion, a second closure mechanism, a second plurality of attachment members, and a second exterior pocket, the second outer side portion, the second inner side portion, and the second heel portion being coupled together to define a second opening of the second sleeve, responsive to the second closure mechanism being in an open position, the second outer side portion and the second inner side portion are at least partially disconnected from one another such that the second opening of the second sleeve in a first configuration to aid the second sleeve in receiving a second of the pair of footwear, responsive to the second closure mechanism being in a closed position, the second opening of the second sleeve is in a second configuration such that the second sleeve is configured to secure the second of the pair of footwear therein, the second plurality of attachment members being positioned adjacent to the second opening, the second exterior pocket being coupled to an exterior surface of the second heel portion and being configured to be inverted and house therein the second outer side portion, the second inner side portion, the second heel portion, and the second sole portion; and a strap configured to be removably coupled to the first sleeve and the second sleeve, the strap including a pair of coupling mechanisms, each of the pair of coupling mechanisms being configured to couple with one or more of the plurality of attachment members of the first sleeve and one or more of the plurality of attachment members of the second sleeve.

2. The system of claim 1, wherein the first sleeve and the strap are configured to fit within the second exterior pocket of the second sleeve, and wherein the second sleeve and the strap are configured to fit within the first exterior pocket of the first sleeve.

3. The system of claim 1, wherein the first sleeve, the strap, the second outer side portion, the second inner side portion, the second heel portion, and the second sole portion are all configured to fit within the second exterior pocket of the second sleeve.

4. The system of claim 1, wherein the second sleeve, the strap, the first outer side portion, the first inner side portion, the first heel portion, and the first sole portion are all configured to fit within the first exterior pocket of the first sleeve.

5. The system of claim 1, wherein the first plurality of attachment members includes a first attachment member, a second attachment member, and a third attachment member, the first attachment member is coupled to the first outer side portion adjacent to the first opening, the second attachment member is coupled to first inner side portion adjacent to the first opening, and the third attachment member is coupled to the first heel portion adjacent to the first opening.

6. The system of claim 5, wherein the second plurality of attachment members includes a first attachment member, a second attachment member, and a third attachment member, the first attachment member is coupled to the second outer side portion adjacent to the second opening, the second attachment member is coupled to second inner side portion adjacent to the second opening, and the third attachment member is coupled to the second heel portion adjacent to the second opening.

7. The system of claim 1, wherein the first sleeve further includes a first interior pocket configured to store a first insert therein and wherein the second sleeve further includes a second interior pocket configured to store a second insert therein.

8. The system of claim 7, wherein the first insert includes deodorizer material therein and wherein the second insert includes deodorizer material therein.

9. The system of claim 7, wherein the first insert includes therein a battery powered fan, a battery powered heating element, an antimicrobial material, or any combination thereof, and wherein the second insert includes therein a battery powered fan, a battery powered heating element, an antimicrobial material, or any combination thereof.

10. The system of claim 7, wherein the first interior pocket is coupled to an interior surface of the first heel portion and wherein the second interior pocket is coupled to an interior surface of the second heel portion.

11. The system of claim 10, wherein the first interior pocket has an extended generally tubular shape with a length that is at least about fifty percent of a length of the first sole portion and wherein the second interior pocket has an extended generally tubular shape with a length that is at least about fifty percent of a length of the second sole portion.

12. The system of claim 11, wherein the first interior pocket is configured to pivot in a first general direction relative to the first heel portion to aid the first sleeve in receiving the first of the pair of footwear therein and responsive to the first of the pair of footwear being secured in the first sleeve, the first interior pocket is configured to pivot in a second general direction relative to the first heel portion to position the first interior pocket inside the first of the pair of footwear.

13. The system of claim 1, wherein the first outer side portion is a mirror image of the first inner side portion.

* * * * *